US006347705B1

(12) United States Patent
Futrell

(10) Patent No.: US 6,347,705 B1
(45) Date of Patent: Feb. 19, 2002

(54) REORDER MEDICATION CONTAINER

(76) Inventor: William R. Futrell, P.O. Box 768, Jackson, NC (US) 27845

( * ) Notice: Subject to any disclaimer, the term of this patent is extended or adjusted under 35 U.S.C. 154(b) by 0 days.

(21) Appl. No.: 09/676,762

(22) Filed: Dec. 14, 2000

(51) Int. Cl.[7] ..... B65D 83/04
(52) U.S. Cl. ..... 206/534; 206/538; 53/467
(58) Field of Search ..... 206/459.5, 528, 206/533, 534–536, 538–540, 232; 215/6, 228; 53/409, 467, 473

(56) References Cited

U.S. PATENT DOCUMENTS

| | | | | | |
|---|---|---|---|---|---|
| 2,335,016 | A | * | 11/1943 | Lorenzen et al. | 206/538 |
| 2,790,587 | A | * | 4/1957 | Contant | 206/534 |
| 3,027,000 | A | * | 3/1962 | Kantrow | 206/536 |
| 3,162,301 | A | | 12/1964 | Cage, Jr. | |
| 3,367,484 | A | | 2/1968 | Nelson | |
| 3,477,561 | A | | 11/1969 | Espinal | |
| 4,151,910 | A | * | 5/1979 | Yasur | 206/540 |
| 4,420,083 | A | | 12/1983 | Baustin | |
| 4,453,636 | A | | 6/1984 | Meadows et al. | |
| 4,475,654 | A | | 10/1984 | Fruchter | |
| 4,805,789 | A | | 2/1989 | Lancesseur et al. | |
| 5,819,944 | A | | 10/1998 | Terrasi | |
| 5,850,919 | A | | 12/1998 | Freed | |
| 6,036,017 | A | | 3/2000 | Bayliss, IV | |

* cited by examiner

*Primary Examiner*—Luan K. Bui
(74) *Attorney, Agent, or Firm*—Mills Law Firm PLLC

(57) ABSTRACT

A medication container includes a labeled separator disc segmenting medications in a prescription into an upper volume and a lower volume. The lower volume contains sufficient medication to enable reordering of the prescription without interruption. After the upper volume is depleted the disc is removed and the label information may be used for reordering via mail, telephone or personal purchase.

12 Claims, 1 Drawing Sheet

FIG. 1
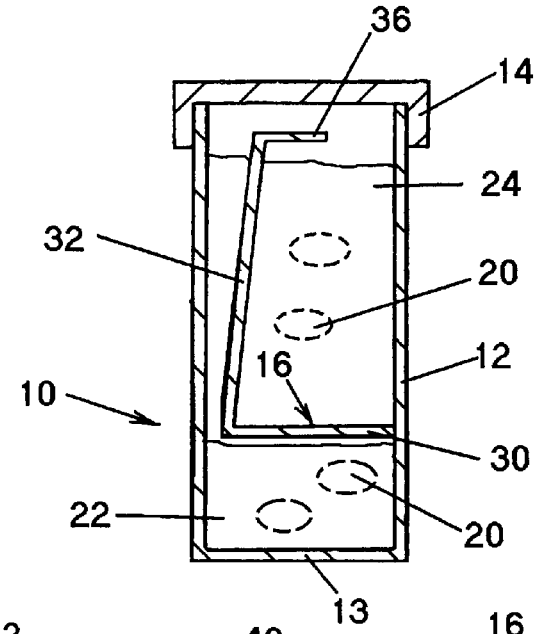
FIG. 2
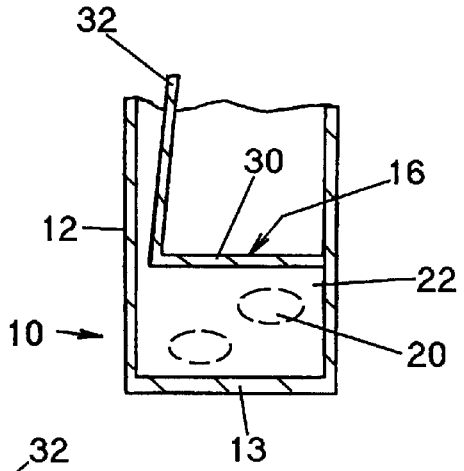
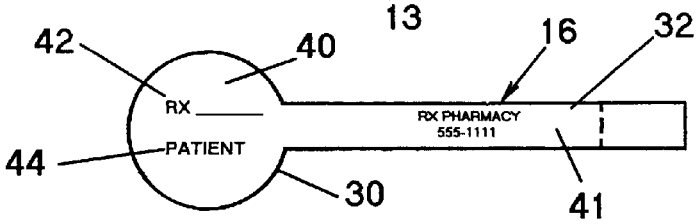
FIG. 3
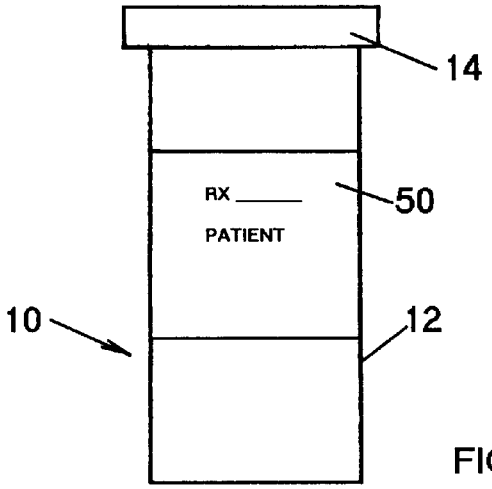
FIG. 4
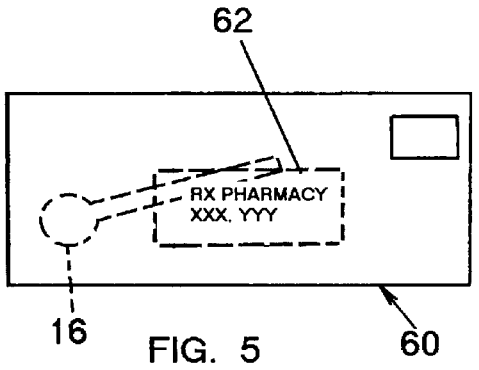
FIG. 5

REORDER MEDICATION CONTAINER

FIELD OF THE INVENTION

The present invention relates to containers for medications, and, in particular, to a medication container for improving compliance in prescription regimens through prompting for timely refilling.

BACKGROUND OF THE INVENTION

Non-compliance with medication regimens represents a significant health care problem to patients who, for proper treatment and health maintenance, require prescriptive medications. It is estimated that 25–49% of all people taking prescribed medications are non-compliant for varying reasons including missed dosages oftentimes for failure to reorder a prescription. The elderly are at greatest risk where it is estimated that 50 to 75% are considered non-compliant. In 1995 medication related incidences wherein non-compliance was an important factor, resulted in $76.6 billion in direct medical costs. Furthermore, an estimated one-third of hospitalizations and one-half of nursing home admission for the elderly were linked to non-compliance or medication errors.

In seeking to address the foregoing, various medication aids have been proposed including pill boxes, containers, calendars, identification cards, and electronic devices. While helpful to a degree, they do not provide a complete and flexible response to the numerous factors influencing non-compliance. While facilitating timely medication, these approaches do not address a common form of non-compliance, namely lack of medicine due to lack of reorder of the prescription on a timely basis.

For example, U.S. Pat. No. 5,850,919 to Freed a compliance closure includes a plurality of removable dividers for segmenting a medication regimen. The closure is intended only to separate into periodic intervals dosages that have been prearranged.

U.S. Pat. No. 6,036,017 to Bayliss discloses a safety prescription container having a separate compartment for housing a specimen medication for viewing through a magnifying lens to verify compliance in the filling of the prescription.

U.S. Pat. No. 4,805,789 to Lancesseur et al. discloses a packaging for pills and tablets having a removable pill compartment for the temporary storage of a patient's secondary medication when distant from the normal residence. The packaging is not intended for allocation of a single medicine.

U.S. Pat. No. 4,475,654 to Frutcher discloses a supplemental storage cap for a limited quantity of medicine that is carried by a main container that houses the remainder of the prescription. The purpose of the storage cap is to facilitate dispensing of the medicine.

U.S. Pat. No. 4,453,636 to Meadows et al. discloses a medicine container having a disc dividing the medicine container into separate compartments. The lower compartment contains a mechanical indicator for visibly denoting unauthorized prior opening of the container. The lower compartment is not intended for medications. The disc is not removable.

U.S. Pat. No. 4,420,083 to Baustin discloses a pill container having a central partition defining separated pill compartments. One compartment holds the daily dosage. The other compartment holds the remaining prescription. The partition is deflectable to allow selective dispensing of the daily dosage.

U.S. Pat. No. 3,162,301 to Cage discloses a pill dispenser having a telescopic member having a plurality of compartments for selectively dispensing medication dosages at discrete times. The dispenser handle the medication regiment for a single day.

U.S. Pat. No. 3,477,561 to Espinal discloses a pill dispenser wherein a shiftable disc is cam operated to raise and lower within a pill compartment for periodic dispensing of medications and to denote the time period of the last dosage. The disc is not removable and does not separate the medication into separate compartments.

U.S. Pat. No. 3,367,484 to Nelson discloses a medication container having an internal disc that establishes a lower compartment in which a specimen medication is permanently housed to enable visual verification of the filled prescription against the prescribed medication.

From the foregoing, it will be apparent that many approaches have been advanced for increasing compliance through the use of specially designed pill containers. Most however have focused on interval dosing, compliant filling, and ease of dispensing, rather than the equally important compliance issue of timely reordering for maintaining, without interruption, the prescribed medication regimen. While packaging of medications into dosing subpackages have been proposed wherein completing a primary volume is intended to provide notification for reordering, such approaches have required specialized and costly packaging incompatible with existing containers. Such plural compartments also do not provide tangible evidence of a reordering event, or the patient and the prescription for which reordering is intended.

BRIEF SUMMARY OF THE INVENTION

The present invention provides an affirmative reordering system for prescription medication containers that is fully compatible with standard pill and tablet containers. The system is supplementally integrated with the standards containers and does not require costly redesign, provides tangible evidence of the need to reorder in sufficient time for non-interrupted dosing compliance, uniquely identifies the patient and prescription, and creates a communication vehicle for remote or personal refilling of the prescription. The foregoing is accomplished by a removable separator that is slidably disposed in the medicine container and selectively positioned and removed by an attached stem. The separator carries indicia indicating the prescription designation and the patient. Upon filling the prescription, the pharmacy fills the container with a first volume of the medication in an amount determined to be an adequate amount to provide sufficient time for processing refilling. The separator is inserted over the initial supply with the stem projecting upwardly therefrom. Thereafter, the remaining amount of the medication is disposed over the separator, the stem placed below the container rim, and the closure applied. The patient or caregiver dispenses the medication preferentially from the upper volume until depleted. To gain access to the lower compartment, the separator must be removed by the stem, and subsequent dispensing proceeds from the remaining lower volume. The removed separator provides a tangible information and communication vehicle for reorder. Accordingly, the separator may be used as information and documentation for telephone reordering or personal delivery and pickup. Preferably, the container may be accompanied by a pre-stamped envelope addressed to the dispensing pharmacy and the separator mailed for refill and delivery, a particular benefit for patients without convenient access to the alternative communication modes, or for health care facilities aggregating reorders.

Accordingly, it is an object of the present invention to provide a medication container providing tangible indication enabling timely reordering of a prescription.

Another object of the invention is to provide a reordering system for prescription medication that may be incorporated into existing medication containers.

A further object of the invention is to provide a method for filling prescription medication containers that provides timely notification of the need and written information required for reordering.

A still further object of the invention is to provide a reordering medication container providing removable documentation when a medication is partially utilized that may be used for the convenient reordering of the prescription.

DESCRIPTION OF THE DRAWINGS

The above and other objects and advantages of the present invention will become apparent upon reading the following detailed description taken in conjunction with the accompanying drawings in which:

FIG. 1 is a side cross sectional view of a reorder medication container according to the invention illustrating the filled condition;

FIG. 2. is a fragmentary side cross sectional view of the reorder medication container in the recorder condition;

FIG. 3 is plan view of the reorder separator for the reorder medication container;

FIG. 4 is a side elevational view of the reorder medication container; and

FIG. 5 is a plan view of a return envelope for submitting the reorder separator for refilling of a prescription.

DETAILED DESCRIPTION OF THE PREFERRED EMBODIMENTS

Referring to the drawings for the purpose of describing the preferred embodiment and not for limiting same, FIG. 1 illustrates a reordering medication container 10 including an open-end cylindrical container body 12 having a circular base 13, a cylindrical a removable closure 14, and a reordering separator 16. As those in the art will appreciate, the container body 12 and the closure may take many conventional forms of container widely commercially used in the filing of prescription medicines. Generally, the body 12 is a plastic molding of a clear or translucent material. The inner surfaces of the body 12 and the base 13 define an interior volume for holding the prescription contents. The closure 14 is adapted to mechanically or frictionally engage the upper end of the body for effecting secure closure of the medications therewithin.

The separator 16 is disposed axially intermediate the interior volume of the body and serves to separate tablet or capsule medications 20 into a lower reorder volume 22 and an upper refill volume 24 together constituting a prescribed amount, in the filled condition, of the medication for a single prescription order for a patient. As described in greater detail below, the reorder volume, in the reorder condition, holds sufficient medication to enable the patient to reorder and refill, accounting for processing times, a prescription prior to exhausting the prescription contents. While such amount for the lower volume may vary depending on patient or pharmaceutical preference, generally a five to ten day supply of medication is segmented by the separator 16 in the lower volume. Accordingly, the upper volume constitutes the remainder of the medication and is preferentially used by the patient until exhausted at the reorder condition shown in FIG. 2, at which time the separator 16 is removed to secure access to the lower volume.

The separator 16, as shown in FIG. 3, includes a circular disc 30 and an elongate removal stem 32. The disc 30 has a sliding or light compressive fit with the inner wall of the container body allowing the disc 30 to be inserted into overlying engagement with the medications in the lower volume. The removal stem 32 is attached at the side of the disc 30 and, through folding or forming, extends normal thereto along the inner wall of the container body. The arm 32 has sufficient length to enable a user to grasp the free end for removal of the separator from the container when the upper volume of medications is depleted. The stem 32 is provided with a folding or integral hook portion 36 at the distal end for enhancing grasping thereof for removal. The length of the stem is sufficiently long to handle relative allocations between the housed volumes. Any outwardly projecting portion of the arm may be folded within the interior at time of closure.

The disc 30 is provided with an indicia fields 40, 41 for displaying information related to the prescription, patient, and other data to enable the refill of the prescription for reordering through telephone, delivery or mailing communication initiatives. Generally, the indicia fields 40, 41 will include a prescription number 42 for the medication in the container, the name of the patient 44, and ancillary information such as a bar code, pharmacy designation include telephone and mailing specifics, medication identity, dosage regimen, prescribing physician, and other information pertinent to the prescription.

The separator 16 may be formed of any suitable material such a plastic or paper product. The fields 40, 41 may be directly imprinted thereon or attached on a suitable carrier label. A label 50, conventionally attached to the outer wall of the container body 12, carries all required information regarding the prescription, including information parallel or supplemental to the information on the disk field 40. As shown in FIG. 5, each time the prescription is filled or refilled, an addressed envelope 60 may be included for use by the patient in refilling the prescription by enclosing therewithin the removed separator tab and addressed in addressee filed 62 to the refilling pharmacy. Should the patient desire this refilling initiative, the envelope is posted to the filling pharmacy, refilled by the pharmacy, and delivered to the patient in refilled form along with another return envelope.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A medication container for assisting the reordering of a prescription of a medication in prior to completion, comprising: a container body having an interior volume; a first volume of the medication in a lower portion of said container body; a separation member in said interior volume overlying said first volume of medication; indicia means on said separator member identifying the prescription; elongated removal means attached to said separation member and extending toward an upper portion of said container body for permitting removal of said separation member without disturbing said first volume; a second volume of medication constituting the balance of the prescription disposed in said interior volume and spaced from said first volume by said separation member; and removable closure means engaging said upper portion of said container body for enclosing said interior volume.

2. The medication container as recited in claim 1 wherein said indicia means includes an identifier for said prescription.

3. The medication container as recited in claim 2 wherein said indicia means includes an identifier for the designee of the prescription.

4. The medication container as recited in claim 3 wherein said removable closure means extends outwardly of said container body.

5. The medication container as recited in claim 4 wherein said indicia means is adhesively secured to said separator.

6. The medication container as recited in claim 3 wherein said separation member is slidably received within said container body.

7. The medication container as recited in claim 6 wherein said separation member includes information regarding refilling the prescription.

8. The medication container as recited in claim 7 including an envelope addressed to the filler of the prescription.

9. A reordering medication container for informing and assisting a user in the reordering of a prescription for a medication, comprising: a container body having a cylindrical inner wall, a circular base and an upper rim; a separation disc conformal to said cylindrical inner wall and slidable with respect thereto between said base and said upper rim; an indicia carried by said separation disc identifying said user and said prescription; an elongated member attached to said separation disc and having a length about the length of said inner wall; and a lid removably engagable with said upper rim for sealing said container body.

10. A method of reordering a prescription for medication of a user, comprising the steps of: providing a container with an interior volume; filling a first portion of said interior volume with a first amount of medication; inserting a separating member into said interior volume and over said first amount of medication; indicating on said separating member the medication and the user; filling a second portion of said interior volume spaced from said first portion by said separating member with a second amount of medication; providing an elongated member on said separating member for permitting removal thereof to permit access to said first portion; removing said separating member from said interior volume after removal of said second amount of medication; and after said removing and based on said indicating reordering said prescription.

11. The method of reordering medication as recited in claim 10 including providing an envelope addressed to the filler of said prescription, inserting said separating member into said envelope, and delivering said envelope to the filler.

12. The method of reordering medication as recited in claim 10 including allocating sufficient medication in said first portion to permit sufficient time for refilling the prescription prior to use of said second portion.

* * * * *